US010305260B2

(12) United States Patent
Yoshida et al.

(10) Patent No.: US 10,305,260 B2
(45) Date of Patent: May 28, 2019

(54) SPARK PLUG INCLUDING AN INSULATOR WITH A FRONT END PORTION HAVING FIRST AND SECOND SECTIONS

(71) Applicant: NGK SPARK PLUG CO., LTD., Nagoya-shi, Aichi (JP)

(72) Inventors: Haruki Yoshida, Tajimi (JP); Kuniharu Tanaka, Komaki (JP); Toshinori Takeichi, Komaki (JP); Michitaka Yamada, Tajimi (JP); Yusuke Nomura, Aichi (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 0 days.

(21) Appl. No.: 16/033,661

(22) Filed: Jul. 12, 2018

(65) Prior Publication Data

US 2019/0020181 A1 Jan. 17, 2019

(30) Foreign Application Priority Data

Jul. 14, 2017 (JP) ..... 2017-137682

(51) Int. Cl.
*H01T 13/34* (2006.01)
*H01T 13/52* (2006.01)
*H01T 13/46* (2006.01)

(52) U.S. Cl.
CPC ..... *H01T 13/34* (2013.01); *H01T 13/52* (2013.01); *H01T 13/467* (2013.01)

(58) Field of Classification Search
CPC ..... H01T 13/34; H01T 13/52; H01T 13/467
See application file for complete search history.

(56) References Cited

U.S. PATENT DOCUMENTS

| | | | | |
|---|---|---|---|---|
| 6,208,066 | B1 * | 3/2001 | Kokubu | H01T 13/52 313/141 |
| 7,557,496 | B2 * | 7/2009 | Kato | H01T 13/14 313/112 |
| 8,395,307 | B2 * | 3/2013 | Suzuki | H01T 13/14 313/118 |
| 2009/0102345 | A1 * | 4/2009 | Hotta | F02P 13/00 313/120 |
| 2010/0206256 | A1 | 8/2010 | Kishimoto et al. | |

(Continued)

FOREIGN PATENT DOCUMENTS

| | | |
|---|---|---|
| JP | H09-264535 | 10/1997 |
| JP | 2009/026469 A | 2/2009 |

(Continued)

*Primary Examiner* — Tracie Y Green
(74) *Attorney, Agent, or Firm* — Kusner & Jaffe

(57) ABSTRACT

Disclosed is a spark plug including: an insulator having an axial hole formed along an axis of the spark plug; a center electrode disposed in a front end side of the axial hole; and a metal shell fixed around an outer circumference of the insulator, with a front end portion of the insulator protruding frontward from a front end of the metal shell. The front end portion of the insulator consists only of a first section and a second section located adjacent to and frontward of the first section and having an inner diameter larger than that of the first section. The second section has a chamfered area formed on an inner circumferential surface thereof so as to continue to a front end of the insulator.

7 Claims, 5 Drawing Sheets

(56) References Cited

U.S. PATENT DOCUMENTS

| | | | | |
|---|---|---|---|---|
| 2012/0153800 | A1* | 6/2012 | Nunome | H01T 13/20<br>313/141 |
| 2013/0009535 | A1 | 1/2013 | Mori | |
| 2017/0256917 | A1* | 9/2017 | Fujimura | H01B 17/56 |
| 2017/0353013 | A1* | 12/2017 | Yoshida | H01T 13/38 |

FOREIGN PATENT DOCUMENTS

| | | | |
|---|---|---|---|
| JP | 2011/146130 | A | 7/2011 |
| JP | 2013/165016 | A | 8/2013 |

* cited by examiner

FIG. 3A

| Sample No. | Ra (μm) | Lb (μm) | Thermal shock resistance |
|---|---|---|---|
| 1 | 0.03 | 30 | 10 |
| 2 | 0.04 | 30 | 10 |
| 3 | 0.1 | 30 | 10 |
| 4 | 1 | 30 | 8 |
| 5 | 2 | 30 | 1 |
| 6 | 1 | 0 | 1 |
| 7 | 0.1 | 0 | 1 |

FIG. 3B

| Sample No. | Ra (μm) | Lb (μm) | AG (°) | Thermal shock resistance | Fouling resistance |
|---|---|---|---|---|---|
| 8 | 0.1 | 30 | 30 | 10 | 5 |
| 9 | 0.1 | 30 | 75 | 10 | 10 |
| 10 | 0.1 | 30 | 90 | 10 | 10 |
| 11 | 0.1 | 30 | 105 | 10 | 10 |
| 12 | 0.1 | 30 | 150 | 5 | 10 |

FIG. 3C

| Sample No. | Ra (μm) | Lb (μm) | Thermal shock resistance | Withstand voltage |
|---|---|---|---|---|
| 13 | 0.1 | 1 | 5 | 10 |
| 14 | 0.1 | 5 | 8 | 10 |
| 15 | 0.1 | 15 | 10 | 10 |
| 16 | 0.1 | 30 | 10 | 10 |
| 17 | 0.1 | 80 | 10 | 10 |
| 18 | 0.1 | 100 | 10 | 10 |
| 19 | 0.1 | 200 | 10 | 8 |
| 20 | 0.1 | 500 | 10 | 7 |
| 21 | 0.1 | 1000 | 10 | 5 |

FIG. 3D

| Sample No. | Ra (μm) | Lb (μm) | Lc (mm) | Thermal shock resistance | Withstand voltage |
|---|---|---|---|---|---|
| 22 | 0.1 | 30 | 0.05 | 9 | 10 |
| 23 | 0.1 | 30 | 0.1 | 10 | 10 |
| 24 | 0.1 | 30 | 0.2 | 10 | 10 |
| 25 | 0.1 | 30 | 3 | 10 | 10 |
| 26 | 0.1 | 30 | 5 | 10 | 8 |

SPARK PLUG INCLUDING AN INSULATOR WITH A FRONT END PORTION HAVING FIRST AND SECOND SECTIONS

FIELD OF THE INVENTION

The present invention relates to a spark plug. Hereinafter, the term "front" refers to a spark discharge side with respect to the direction of an axis of a spark plug; and the term "rear" refers to a side opposite the front side.

BACKGROUND OF THE INVENTION

A spark plug is conventionally used in an internal combustion engine to ignite a fuel gas in a combustion chamber of the internal combustion engine. For example, there is known a spark plug of the type having a cylindrical insulator formed with an axial hole in the direction of an axis of the spark plug, a metal shell fixed around an outer circumference of the insulator and a center electrode partially inserted in a front end side of the axial hole. See Japanese Laid-Open Patent Publication No. 2009-26469; Japanese Laid-Open Patent Publication No. H09-264535; Japanese Laid-Open Patent Publication No. 2013-165016; and Japanese Laid-Open Patent Publication No. 2011-146130.

The insulator of the spark plug changes in temperature according to the status of the internal combustion engine. For example, the temperature of the insulator is increased by heat from combustion gas. The temperature of the insulator is decreased by introduction of fresh air into the combustion chamber. In this way, the insulator undergoes repeated temperature changes.

Herein, the insulator expands with increase in temperature and contracts with decrease in temperature. The insulator thus repeatedly expands and contracts according to repeated temperature changes. This can result in breakage of the insulator. In order to suppress such breakage of the insulator, it is conceivable to decrease the thickness of the insulator and thereby relieve stress caused to the insulator by expansion and contraction. When the thickness of the insulator is decreased, however, there arises a possibility of an unintentional discharge occurring between the center electrode and the metal shell through the insulator.

An advantage of the present invention is a spark plug capable of, while preventing an unintentional discharge from occurring between a center electrode and a metal shell through an insulator, improving the durability of the insulator against temperature changes.

SUMMARY OF THE INVENTION

The present invention can be embodied in the following aspects.

In accordance with a first aspect of the present invention, there is provided a spark plug, comprising: an insulator having an axial hole formed in a direction of an axis of the spark plug; a center electrode disposed in the axial hole and having a part thereof corresponding in position to at least a front end of the insulator; and a metal shell fixed around an outer circumference of the insulator, with a front end portion of the insulator protruding frontward from a front end of the metal shell, wherein the front end portion of the insulator consists only of a first section located on a rear side thereof and a second section located adjacent to and frontward of the first section and having an inner diameter larger than that of the first section, and wherein the second section has, formed on an inner circumferential surface thereof, a chamfered area continuing to the front end of the insulator.

In this configuration, the chamfered area is formed on the connection part between the front end and inner circumferential surface of the insulator; and the front end portion of the insulator, which is located frontward of the front end of the metal shell, is constituted by only the first (rear-side) section and the second (front-side) section of larger inner diameter than the first section. It is therefore possible to improve the durability of the insulator against temperature changes while effectively suppressing the occurrence of an unintentional discharge between the center electrode and the metal shell through the insulator.

In accordance with a second aspect of the present invention, there is provided a spark plug as described above, wherein an inner circumferential surface of the first section includes a connection surface region facing frontward and connected to the second section, and wherein, assuming that, in a cross section of the spark plug taken including the axis, a straight line passes through both ends of a line segment corresponding to the connection surface region, an angle formed between the axis and the straight line on a side frontward of the connection surface region is 75 degrees or greater.

In this configuration, it is possible to effectively prevent combustion gas from flowing through a clearance between the insulator and the center electrode along the connection surface region to the rear of the connection surface region.

In accordance with a third aspect of the present invention, there is provided a spark plug as described above, wherein a distance between inner circumferential surfaces of minimum inner diameter parts of the first and second sections in a direction perpendicular to the axis is greater than or equal to 5 μm and smaller than or equal to 500 μm.

In this configuration, it is possible to effectively improve the durability of the insulator against temperature changes while suppressing the occurrence of an unintentional discharge through the insulator.

In accordance with a fourth aspect of the present invention, there is provided a spark plug as described above, wherein a distance between inner circumferential surfaces of minimum inner diameter parts of the first and second sections in a direction perpendicular to the axis is greater than or equal to 15 μm and smaller than or equal to 100 μm.

In this configuration, it is possible to effectively improve the durability of the insulator against temperature changes while suppressing the occurrence of an unintentional discharge through the insulator.

In accordance with a fifth aspect of the present invention, there is provided a spark plug as described above, wherein a distance from the front end of the insulator to a rear end of the second section in the direction of the axis is 0.1 mm or greater.

In this configuration, it is possible to effectively improve the durability of the insulator against temperature changes.

In accordance with a sixth aspect of the present invention, there is provided a spark plug as described above, wherein an inner circumferential surface of the front end portion of the insulator has a surface roughness of 1 μm or smaller.

In this configuration, it is possible to effectively improve the durability of the insulator against temperature changes by suppressing unintentional unevenness of the inner circumferential surface of the insulator.

In accordance with a seventh aspect of the present invention, there is provided a spark plug as described above, wherein the chamfered area is a C-chamfered area or a R-chamfered area.

In this configuration, it is possible to effectively improve the durability of the insulator against temperature changes by suppressing the concentration of stress on the chamfered area.

It should be noted that the present invention can be embodied in various forms such as not only a spark plug but also an ignition device with a spark plug, an internal combustion engine having mounted thereon a spark plug, an internal combustion engine having mounted thereon an ignition device with a spark plug, and the like.

Other advantages and features of the present invention will also become understood from the following description.

BRIEF DESCRIPTION OF DRAWINGS

FIGS. 3A to 3D show tables of results of evaluation tests of the insulator shown in FIG. 2.

DETAILED DESCRIPTION OF THE INVENTION

A. First Embodiment

Figure 1:
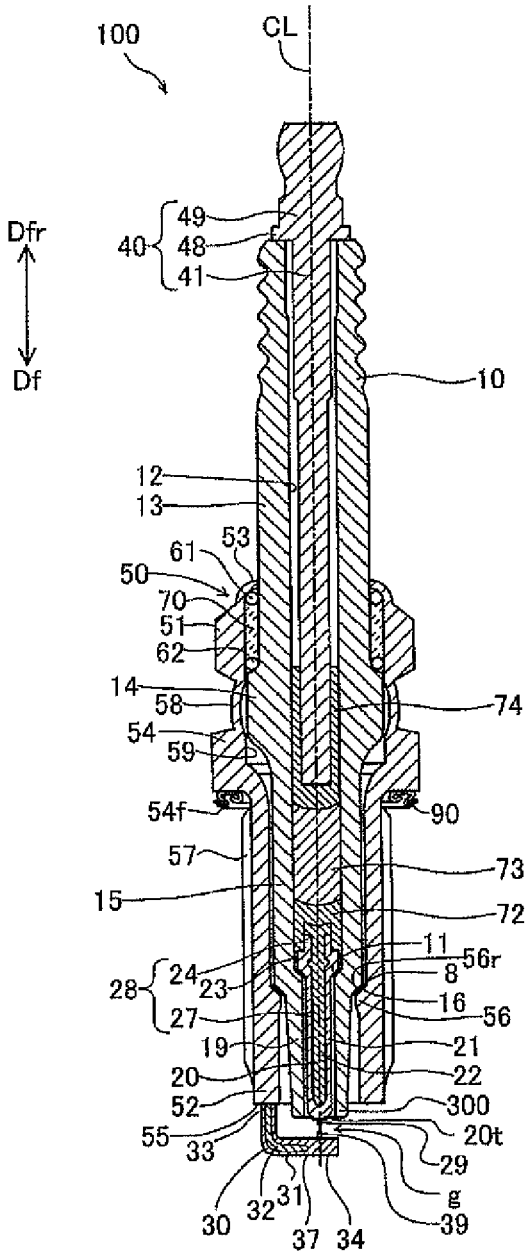
FIG. 1 shows a cross-sectional view of a spark plug according to a first embodiment of the present invention.

FIG. 1 shows a cross-sectional view of a spark plug 100 according to a first embodiment of the present invention. In FIG. 1, a center axis CL of the spark plug 100 (also simply referred to as "axis CL") is indicated by a dot-dash line; and a cross section of the spark plug 100 is taken including the axis CL. In the following description, a direction parallel to the axis CL is also referred to as a direction of the axis CL" or referred to as an "axial direction" or "vertical direction"; a direction of the radius of a circle about the axis CL is also referred to as a "radial direction"; and a direction of the circumference of a circle about the axis CL is also referred to as a "circumferential direction". The lower and upper sides in FIG. 1 are respectively correspond to front and rear sides of the spark plug 100. Further, directions toward the front and rear sides of the spark plug 100 with respect to the axis CO are respectively indicated by arrows Df and Dfr in the drawings.

As shown in FIG. 1, the spark plug 100 includes: a cylindrical insulator 10 having a through hole 12 (also referred to as "axial hole 12") formed therein along the axis CL; a center electrode 20 held in a front end side of the through hole 12; a terminal electrode 40 held in a rear end side of the through hole 12; a resistor 73 arranged between the center electrode 20 and the terminal electrode 40 within the though hole 12; a first conductive seal member 72 held in contact with the center electrode 20 and the resistor 73 to establish electrical connection between the center electrode 20 and the resistor 73; a second conductive seal member 74 held in contact with the terminal electrode 40 and the resistor 73 to establish electrical connection between the terminal electrode 40 and the resistor 73; a cylindrical metal shell 50 fixed around an outer circumference of the insulator 10; and a ground electrode 30 having one end (base end) joined to a front end surface 55 of the metal shell 50 and the other end (distal end) facing the center electrode 30 via a predetermined gap g.

The insulator 10 includes a large-diameter portion 14, a rear body portion 13, a front body portion 15, an outer diameter decreasing portion 16 and a leg portion 19. The large-diameter portion 14 is located at a substantially middle position of the insulator 10 in the axial direction and has the largest outer diameter. The rear body portion 13 is located rearward of the large-diameter portion 14 and has an outer diameter smaller than that of the large-diameter portion 14. The front body portion 15 is located frontward of the large-diameter portion 14 and has an outer diameter smaller than that of the rear body portion 13. The outer diameter decreasing portion 16 is located frontward of the front body portion 15 and has an outer diameter gradually decreasing in the frontward direction Df. The leg portion 19 is located frontward of the outer diameter decreasing portion 16 and has an outer diameter smaller than that of the outer diameter decreasing portion 16. The insulator 10 also includes an inner diameter decreasing portion 11 formed in the vicinity of the outer diameter decreasing portion 16 (in the first embodiment, inside the front body portion 15) and having an inner diameter gradually decreasing in the frontward direction Df. Preferably, the insulator 10 is made of a material having mechanical strength, thermal strength and electrical strength. For example, the insulator 10 is made of sintered alumina in the first embodiment. It is needless to say that any other insulating material can alternatively be used as the material of the insulator 10.

The center electrode 20 is made of a metal material and inserted in the front end side of the through hole 12 of the insulator 10. In the first embodiment, the center electrode 20 consists of a substantially rod-shaped electrode body 28 and a first electrode tip 29.

The electrode body 28 includes a head portion 24 located on a rear end side thereof and a shaft portion 27 connected to a front end of the head portion 24 and extending in the frontward direction Df along the axis CL. The electrode body 28 further includes a collar portion 23 formed on a front end side of the head portion 24 and having an outer diameter larger than that of the shaft portion 27. A front end surface of the collar portion 23, to which the shaft portion 27 is connected, is supported on the inner diameter decreasing portion 11 of the insulator 10.

More specifically, the shaft portion 27 has an outer layer 21 and a core 22 located on an inner circumferential side of the outer layer 21 in the first embodiment. The outer layer 21 is made of a material having higher oxidation resistance than that of the core 22. As the material of the outer layer 21, there can be used an alloy containing Ni as a main component. The term "main component" as used herein refers to a component contained in the largest amount (% by weight) among all components. On the other hand, the core 22 is made of a material having a higher thermal conductivity than that of the outer layer 21. As the material of the core 22, there can be used pure copper or an alloy containing copper as a main component. Alternatively, the core 22 may be omitted from the shaft portion 27.

The first electrode tip 29 is joined by e.g. laser welding to a front end of the electrode body 28 (shaft portion 27). The first electrode tip 29 is made of a material having higher discharge resistance than that of the shaft portion 27. As the material of the first electrode tip 29, there can be used a noble metal material such as iridium (Ir) or platinum (Pt). The first electrode tip 29 may be omitted from the center electrode 20.

A front end portion of the center electrode 20 including the first electrode tip 29 is exposed outside in the frontward direction Df from the through hole 12 of the insulator 10. Namely, the center electrode 20 is disposed in the through hole 12 of the insulator 10 such that a part of the center electrode 20 corresponds in position to a front end of the insulator 10 (that is, a part of the center electrode 20 is located at the same position as the front end of the insulator 10 in the direction of the axis CL).

The terminal electrode 40 is rod-shaped in parallel with the axis CL and is made of a conductive material such as a metal material containing iron as a main component. The terminal electrode 40 includes a cap attachment portion 49, a collar portion 48 and a shaft portion 41 arranged in this order in the frontward direction Df. The shaft portion 41 is inserted in the rear end side of the through hole 12 of the insulator 10. The cap attachment portion 49 is exposed outside in the rearward direction Dfr from the through hole 12 of the insulator 10.

The resistor 73 is disposed between the terminal electrode 40 and the center electrode 20 within the axial hole 12 of the insulator 10 in order to suppress electrical noise. Herein, the resistor 73 is made of a conductive material such as a mixture of glass, carbon particles and ceramic particles. The first conductive seal member 72 is disposed between the center electrode 20 and the resistor 73, whereas the second conductive seal member 74 is disposed between the terminal electrode 40 and the resistor 73. These conductive seal members 72 and 73 are made of a conductive material such as a mixture of metal particles with the same glass as that contained in the resistor 73. The center electrode 20 is thus electrically connected to the terminal electrode 40 via the first conductive seal member 72, the resistor 73 and the second conductive seal member 74.

The metal shell 50 is cylindrical in shape, with a through hole 59 formed therein along the axis CL, and is fixed around the outer circumference of the insulator 10 by insertion of the insulator 10 through the through hole 59 of the metal shell 50. The metal shell 50 is made of a conductive metal material such as low carbon steel containing iron as a main component.

A front end portion 300 of the insulator 10 is located frontward of a front end (front end surface 55) of the metal shell 50, i.e., exposed outside in the frontward direction Df from the though hole 59 of the metal shell 50. On the other hand, a rear end portion of the insulator 10 is located rearward of a rear end of the metal shell 50, i.e., exposed outside in the rearward direction Dfr from the through hole 59 of the metal shell 50.

The metal shell 50 includes a tool engagement portion 51, a front body portion 52 and a flanged middle body portion 54. The tool engagement portion 51 is adapted for engagement with a spark plug wrench. The front body portion 52 is located so as to continue to the front end surface 55 of the metal shell 50. A mounting thread 57 is provided in the form of a male thread on an outer circumferential surface of the front body portion 52 so as to extend in the direction of the axis CL and be screwed into a mounting hole of a mounting portion of an internal combustion engine (such as gasoline engine). The middle body portion 54 is formed between the tool engagement portion 51 and the front body portion 52 so as to protrude radially outwardly. An outer diameter of the middle body portion 54 is made larger than a maximum outer diameter of the mounting thread 57 (i.e. a diameter of thread ridges of the mounting thread 57). A front end surface of the middle body portion 54 serves as a seat surface **54*f*** to form a seal with the mounting portion (such as engine head) of the internal combustion engine.

An annular metallic gasket 90 is fitted on a part of the metal shell 50 between the mounting thread 57 of the front body portion 52 and the seat surface **54*f* of the middle body portion 54. In a state that the spark plug 100 is mounted to the internal combustion engine, the gasket 90 is compressed and deformed between the seat surface 54*f* and the mounting portion (such as engine head) of the internal combustion engine so as to seal a clearance between the metal shell 50 and the internal combustion engine. Alternatively, the gasket 90 may not be provided so that the clearance between the metal shell 50 and the mounting portion of the internal combustion engine is sealed by direct contact of the seat surface 54*f* of the metal shell 50** with the mounting portion of the internal combustion engine.

The metal shell 50 also includes an inwardly protruding portion 56 radially inwardly from an inner circumferential side of the front body portion 52 and having an inner diameter smaller than that of at least a part located rearward of the inwardly protruding portion 56. In the first embodiment, a rear surface **56*r* of the inwardly protruding portion 56 is formed such that an inner diameter of the rear surface 56*r*** gradually decreases in the frontward direction Df.

A front-side packing 8 is interposed between the rear surface **56*r* of the inwardly protruding portion 56 and the outer diameter decreasing portion 16 of the insulator 10. In the first embodiment, the packing 8 is a plate-shaped packing made of iron. Needless to say, the packing 8 can be made of any other material e.g. metal material such as copper. The outer diameter decreasing portion 16 of the insulator 10 is supported from the front side by the inwardly protruding portion 56 indirectly via the packing 8. Alternatively, the packing 8 may not be provided so that the insulator 10 is supported directly on the inwardly protruding portion 56 by direct contact of the rear surface 56*r* of the inwardly protruding portion 56 with the outer diameter decreasing portion 16 of the insulator 10**.

The metal shell 50 further includes a rear end portion 53 and a connection portion 58. The rear end portion 53 is located rearward of the tool engagement portion 51 so as to continue to the rear end of the metal shell 50 and is made smaller in thickness than the tool engagement portion 51. The connection portion 58 is formed as a connection part between the middle body portion 54 and the tool engagement portion 51 and is made smaller in thickness than the middle body portion 54 and the tool engagement portion 51.

Annular ring members 61 and 62 are disposed in an annular space between an inner circumferential surface of a part of the metal shell 50 from the tool engagement portion 51 to the rear end portion 53 and an outer circumferential surface of the rear body portion 13 of the insulator 10. A powder of talc 70 is filled between the ring members 6 and 7. During manufacturing of the spark plug 100, the rear end portion 53 is crimped radially inwardly, and then, the connection portion 58 is deformed radially outwardly under a compression force. The metal shell 50 and the insulator 10 are consequently fixed together. In this crimping step, the talc 70 is compressed to increase the airtightness between the metal shell 50 and the insulator 10. Further, the packing 8 is compressed between the outer diameter decreasing portion 16 of the insulator 10 and the inwardly protruding portion 56 of the metal shell 50 to establish a seal between the insulator 50 and the insulator 10.

The ground electrode 30 is made of a metal material and inserted in the rear end side of the through hole 12 of the insulator 10. In the first embodiment, the ground electrode 30 consists of a substantially rod-shaped electrode body 37 and a second electrode tip 39.

The electrode body 37 includes a base end portion 33 joined by e.g. resistance welding to the front end surface 55 of the metal shell 50 and a distal end portion 34 located opposite from the base end portion 33. The electrode body 37 is bent at a middle portion thereof such that the base end portion 33 extends from the metal shell 50 in the frontward direction Df and such that the distal end portion 34 extends in the direction perpendicular to the axis CL.

More specifically, the electrode body 37 has an outer layer 31 and an inner layer 32 located on an inner circumferential side of the outer layer 31 in the first embodiment. The outer layer 31 is made of a material having higher oxidation resistance than that of the inner layer 32. As the material of the outer layer 31, there can be used an alloy containing Ni as a main component. On the other hand, the inner layer 32 is made of a material having a higher thermal conductivity than that of the outer layer 31. As the material of the inner layer 32, there can be used pure copper or an alloy containing copper as a main component. Alternatively, the inner layer 32 may be omitted from the electrode body 37.

The second electrode tip 39 is joined by e.g. resistance welding or laser welding to a rear-facing surface of the distal end portion 34 of the electrode body 37. The second electrode tip 39 of the ground electrode 30 is located frontward of the first electrode tip 29 of the center electrode 20 such that the first and second electrode tips 29 and 39 face each other via the gap g. In other words, the discharge gap g is defined between the first and second electrode tips 29 and 39. The second electrode tip 39 is made of a material having higher discharge resistance than that of the electrode body 37. As the material of the second electrode tip 39, there can be used a noble metal material such as iridium (Ir) or platinum (Pt).

Figure 2:
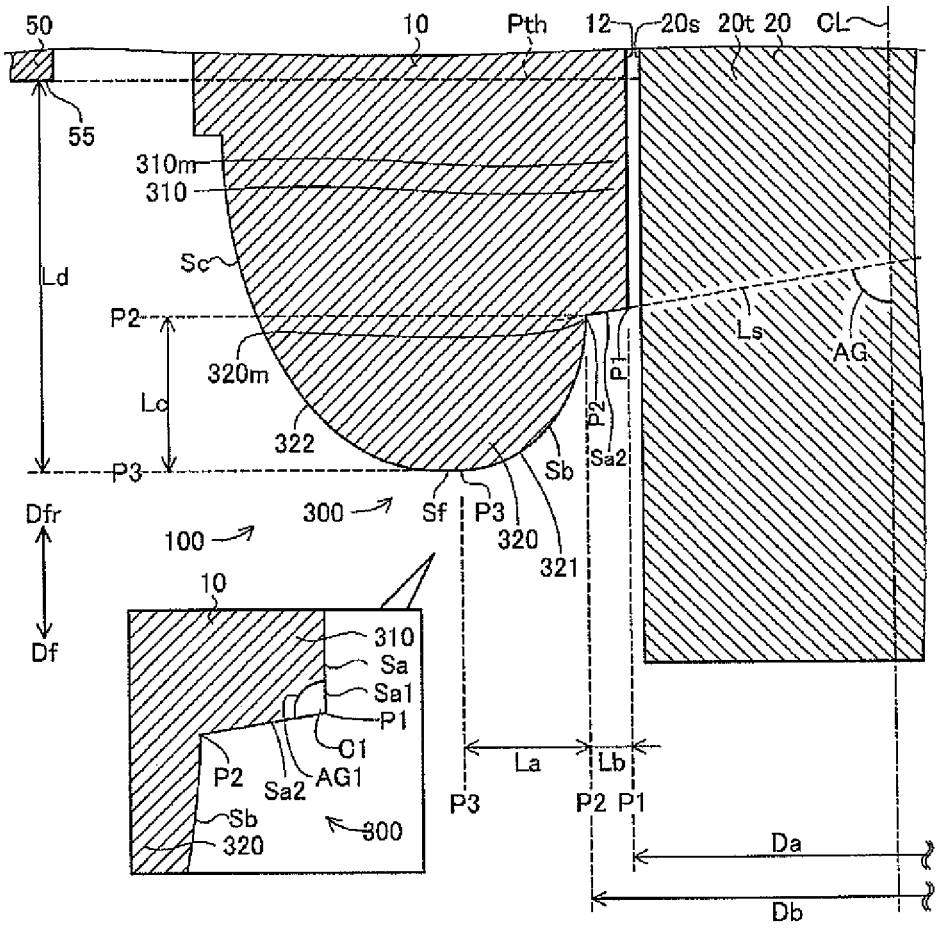
FIG. 2 shows a schematic view showing the vicinity of a front end portion of an insulator of the spark plug according to the first embodiment of the present invention.

FIG. 2 shows a schematic view showing the vicinity of the front end portion 300 of the insulator 10. In FIG. 2, a part of the cross-sectional view of FIG. 1 including a part of the front end portion 300 of the insulator 10, a part of the center electrode 20 and a part of the metal shell 50 is shown in enlargement.

The front end portion 300 of the insulator 10 consists of two sections, i.e., a first (rear-side) section 310 and a second (front-side) section 320 located adjacent to and frontward of the first section 310. The connection part of inner circumferential surfaces Sa and Sb of these first and second sections 310 and 320 is shown in enlargement in the lower left area of FIG. 2.

The inner circumferential surface Sa of the first section 310 includes a first (rear-side) surface region Sa1 and a second (front-side) surface region Sa2 connected to a front side of the first surface region Sa1. The first surface region Sa1 has a constant inner diameter Da throughout its length regardless of the position in the direction of the axis CL. The connection point of the first and second surface regions Sa1 and Sa2 is hereinafter referred to as a first point P1. The second surface region Sa2 faces in the frontward direction Df so that, when the insulator 10 is viewed from the front side in the rearward direction Dfr, the second surface region Sa2 is visually recognizable. The second surface region Sa2 is connected to the inner circumferential surface Sb of the second section 320. The connection point of the second surface regions Sa2 to the inner circumferential surface Sb of the second section 320 is hereinafter referred to as a second point P2.

The connection of the first and second sections 310 and 320 is formed by an inner circumferential edge of the front-facing second surface region Sa2 (that is, the second point P2). In the first embodiment, the second point P2 is situated radially inside and frontward of the first point P1.

The inner diameter of the inner circumferential surface of the front end portion 30 of the insulator 10 is stepwisely changed from the first section 310 to the second section 320, i.e., define a step between the first and second sections 310 and 320. Herein, a region of the inner circumferential surface Sa of the first section 310 facing in the frontward direction Df and connected to the second section 310 is also called a "connection surface region". (In the first embodiment, the second surface region Sa2 corresponds to the connection surface region.)

A front end surface Sf of the insulator 10 is defined as an outer surface of the insulator 10 located frontmost in the direction of the axis CL and is formed by the second section 320. The connection point of the front end surface Sf and the inner circumferential surface Sb of the second section 320 is hereinafter referred to as a third point P3.

As shown in FIG. 2, a chamfered area 321 is formed on the inner circumferential surface Sb of the second section 320 so as to continue to the front end (more specifically, the front end surface Sf) of the insulator 10. In the first embodiment, the chamfered area 321 is in the form of a round chamfered area (also called "R-chamfered area"). The term "R-chamfered" means that the chamfered area has a shape defined by a curve when viewed in cross section. Furthermore, the chamfered area 321 is provided on the entire inner circumferential surface Sb of the second section 320, that is, the inner diameter of the second section 320 gradually decreases in the frontward direction Df throughout the entire inner circumferential surface Sb in the first embodiment.

Herein, a part of the first section 310 having the smallest inner diameter is called a minimum inner diameter part 310*m*. In the first embodiment, the minimum inner diameter part 310*m* corresponds to a part of the first section 310 defining the first surface region Sa1. As the first surface region Sa1 is constant in inner diameter throughout its length as mentioned above, the inner diameter of the first surface region Sa1 corresponds to an inner diameter Da of the minimum inner diameter part 310*m*. The inner diameter Da is hereinafter also called "minimum inner diameter Da".

Similarly, a part of the second section 320 having the smallest inner diameter is called a minimum inner diameter part 320*m*. In the first embodiment, the minimum inner diameter part 320*m* corresponds to a part of the second section 320 (inner circumferential surface Sb) defining the second point P2. Thus, the inner diameter of the second section 320 at the second point P2 corresponds to an inner diameter Db of the minimum inner diameter part 320*m*. The inner diameter Db is hereinafter also called "minimum inner diameter Db". The minimum inner diameter Db of the second section 320 is larger than the minimum inner diameter of the first section 310.

The following definitions are also used in describing the configurations of the front end portion 300 of the insulator 10 (see the after-mentioned evaluation tests):

Ra is a surface roughness of the inner circumferential surface of the insulator 10 (including the inner circumferential surfaces Sa and Sb of the front end portion 300);

La is a length of the chamfered area 320 in a direction perpendicular to the axis CL;

Lb is a distance between the inner circumferential surface of the minimum inner diameter part 310*m* (i.e. the first surface region Sa1) of the first section 310 and the inner circumferential surface of the minimum inner diameter part 320*m* (i.e. the part of the inner circumferential surface Sb defining the second point P2) of the second section 320 in the direction perpendicular to the axis CL;

Lc is a distance from the front end (front end surface Sf) of the insulator 10 to the rear end of the second section 320 (i.e. the second point P2 between the first and second sections 310 and 320) in the direction parallel to the axis CL;

Ld is a distance from the front end (front end surface 55) of the metal shell 50 to the front end (front end surface Sf) of the insulator 10 in the direction parallel to the axis CL;

Ls a straight line passing through both ends of a line segment corresponding to the connection surface region Sa2 in FIG. 2; and AG is an angle formed between the straight line Ls and the axis CL on a side frontward of the connection surface region Sa2.

Moreover, a chamfered area 322 is formed on an outer circumferential surface Sc of the front end portion 300 so as to continue to the front end surface Sf of the insulator 10 as shown in FIG. 2 in the first embodiment. The chamfered area 322 is provided as a round chamfered area. The outer diameter of the front end portion 300 gradually decreases in the frontward direction Df on the chamfered area 322.

In the front end portion 300 of the insulator 10, the second (front-side) section 320 is located closer to a combustion chamber of the internal combustion engine than the first (rear-side) section 310. Namely, the second section 320 is more susceptible to heat from combustion gas than the first section 31. Hence, the second section 310 tends to become higher in temperature than the first section 310 and tends to show greater temperature changes than those of the first section 310.

In the first embodiment, the inner diameter of the second section 320 is larger than the inner diameter of the first section 310. Accordingly, the volume of the second section 320 is made smaller as compared to the case where the inner diameter of the second section 320 is smaller than the inner diameter of the first section 320. In general, the larger the volume, the larger the amount of change of the volume due to temperature changes, the larger the stress caused by changes of the volume (i.e. caused by temperature changes). As the volume of the second section 320 is made small as mentioned above in the first embodiment, the amount of volume change of the second section 320 due to temperature changes of the front end portion 300 is decreased. As a result, the stress caused to the second section 320 (e.g. the connection part between the front end surface Sf and the inner circumferential surface Sb) by temperature changes is reduced. It is therefore possible to suppress damage caused to the second section 320 by temperature changes of the front end portion 300.

Further, the chamfered area 321 is formed on the inner circumferential surface Sb of the second (front-side) section 320 of the front end portion 300 of the insulator 10 so as to continue to the front end (front end surface Sf) of the insulator 10. By the formation of such a chamfered area 321, the stress caused to the front end portion 300 of the insulator 10 by temperature changes is prevented from being concentrated on the connection part between the front end surface Sf and the inner circumferential surface Sb as compared to the case where the connection angle between the front end surface Sf and the inner circumferential surface Sb (with the third point P3 as the vertex) is about 90 degrees. It is thus possible to effectively suppress breakage of the front end portion 300 of the insulator 10 caused by temperature changes.

As compared to the case where the chamfered area 321 is not formed (e.g. the inner circumferential surface Sb is constant in inner diameter so that the connection angle between the front end surface Sf and the inner circumferential surface Sb is about 90 degrees), the volume of the second section 320 is made small by the formation of the chamfered area 320. It is thus possible to effectively suppress damage of the second section 320 caused by temperature changes of the front end portion 300.

As the first (rear-side) section 310 is smaller in inner diameter than the second (front-side) section 320, the radial thickness of the first section 310 is made larger as compared to the case where the inner diameter of the first section 310 is larger than the inner diameter of the second section 320. It is thus possible to prevent a discharge from unintentionally occurring between the center electrode 20 and the metal shell 50 through the insulator 10 (in particular, a discharge penetrating through the first section 310 along a path Pth as shown in FIG. 2).

Furthermore, the connection point (i.e. the second point P2) between the first and second sections 310 and 320 of the front end portion 300 is located frontward of the front end (front end surface 55) of the metal shell 50. If the connection point between the first and second sections 310 and 320 is located rearward of the front end of the metal shell 50, the second section 320 of relatively small thickness is arranged radially inside the front end (front end surface 55) of the metal shell 50. In this case, it is likely that an unintentional discharge will occur between the center electrode 20 and the metal shell 50 (e.g. the front end surface 55) through the insulator 10. In the first embodiment, however, the first section 310 of relatively large thickness is arranged radially inside the front end (front end surface 55) of the metal shell 50. It is thus possible to effectively prevent a discharge from unintentionally occurring between the center electrode 20 and the metal shell 50 through the insulator 10 and suppress damage of the front end portion 300 (in particular, damage of the second section 320).

As shown in FIG. 2, the chamfered area 322 is also formed on the outer circumferential surface Sc of the second section 320 so as to continue to the front end surface Sf in the first embodiment. By the formation of such a chamfered area 322, the stress caused to the front end portion 300 of the insulator 10 by temperature changes is prevented from being concentrated on the connection part between the front end surface Sf and the outer circumferential surface Sc as compared to the case where the connection angle between the front end surface Sf and the outer circumferential surface Sc is about 90 degrees. It is thus possible to effectively suppress breakage of the front end portion 300 of the insulator 10 caused by temperature changes. As compared to the case where the chamfered area 322 is not formed (e.g. the connection angle between the outer circumferential surface Sc and the front end surface Sf is about 90 degrees), the volume of the second section 320 is made small by the formation of the chamfered area 322. It is possible to effectively suppress damage of the second section 320 caused by temperature changes of the front end portion 300.

It is feasible to adopt any method for producing the insulator 10 with the above-configured front end portion 300. For example, the insulator 10 can be produced by the following method. A green raw material powder of e.g. alumina is molded into a shape of the insulator 10 with the use of a plurality of molds. The plurality of molds may include a pin-shaped mold for forming the through hole 12 in the insulator 10, molds for forming the inner circumferential surfaces Sa and Sb, front end surface Sf and outer circumferential surface Sc of the front end portion 300 of the insulator 10 and molds for forming the remaining parts of the inner and outer circumferential surfaces of the insulator 10. Then, the insulator 10 is completed by sintering the thus-molded body. Alternatively, the front end portion 300 may be formed by subjecting the sintered insulator 10 to cutting, grinding etc.

B. Evaluation Tests

In order to study the preferable configurations of the insulator 10, the following evaluation tests were performed on various types of samples of the spark plug 100 in which the configurations of the front end portion 300 of the insulator 10, were varied. FIGS. 3A to 3D show tables of results of the evaluation tests.

B1. First Evaluation Test

The first evaluation test was conducted to examine the influence of the surface roughness Ra and the distance Lb (see FIG. 2) on the thermal shock resistance of the insulator 10. In this evaluation test, seven types of samples of the spark plug 100 (samples No. 1 to No. 7) with different combinations of Ra and Lb were used. Herein, the surface roughness Ra refers to an arithmetic surface roughness (in units of μm) as defined according to JIS B 0601-2001. (The same definition applies to the after-mentioned other samples.) The surface roughness Ra was adjusted by surface polishing the insulator 10 before and after the sintering. The distance Lb was set to 30 μm for samples No. 1 to No. 5 and set to zero for samples No. 6 and No. 7. In each of samples No. 6 and No. 7, the front end portion 300 of the insulator 10 had its inner circumferential surfaces Sa, Sb formed with the chamfered area 321, but no second surface region Sa2 (no step between Sa and Sb), so that the inner circumferential surfaces Sa and Sb were smoothly connected to each other. In other words, the inner diameter Da of the first surface region Sa1 was set equal to the inner diameter of the inner circumferential surface Sb at the rear end (as corresponding to the second point P2 in FIG. 2) in samples No. 6 and No. 7. The other configurations of the spark plug 100 were common to samples No. 1 to No. 7. For example, the following common parameters were used: La=0.9 mm; AG=90°; and Lc=0.3 mm.

The thermal shock resistance, which indicates the durability of the insulator 10 when cooled rapidly from a heated state, was evaluated as follows. Among a plurality of candidate temperatures, the lowest candidate temperature was selected as a heating temperature. While the front end (including the front end surface Sf) of the insulator 10 of the spark plug 100 was measured with a radiation temperature sensor, a part of the spark plug 100 in the vicinity of the discharge gap g was heated by a gas burner such that the measured temperature of the front end of the insulator 100 reached the selected heating temperature. In this heated state, a predetermined amount of water was sprayed onto the center electrode 20. As a result of the water spraying, the center electrode 20 was rapidly cooled. The cooled center electrode 20 drew heat from the front end portion 300 of the insulator 100 surrounding the center electrode 20, whereby the temperature of the front end portion 300 of the insulator 10 was also decreased. It was visually conformed whether there occurred breakage of the front end portion 300 of the insulator 10 by such temperature decrease. When there was no breakage in the front end portion 300, the heating temperature was changed to the next lowest one of the candidate temperatures. The above evaluation operation (heating, cooling and confirmation) was repeated for the changed heating temperature until breakage of the front end portion 300 occurred. The heating temperature at which breakage of the front end portion 300 occurred was determined as a breakage temperature.

The thermal shock resistance score was given as a measure of the breakage temperature. In this evaluation test, the breakage temperature of sample No. 3 was determined as a "reference heating temperature"; and the thermal shock resistance score was set as "10" for the reference heating temperature and was deducted by 1 for every 10-degree decrease in breakage temperature. For example, the thermal shock resistance score was 8 when the breakage temperature was 20° C. lower than the reference heating temperature. The higher the thermal shock resistance score, the higher the breakage temperature, the higher the durability.

Even in an actual internal combustion engine, there will occur temperature decreases of the front end portion 300 of the insulator 10 due to temperature decreases of the center electrode 20. For example, fresh air introduced into a combustion chamber of the internal combustion engine will come into contact with the center electrode 20 and the insulator 10. In view of the fact that the thermal conductivity of a metal material is generally higher than the thermal conductivity of a ceramic material, the temperature of the center electrode 20 will be decreased more quickly than the temperature of the insulator 10 with the introduction of fresh air. As the temperature of the center electrode 20 is decreased, the insulator 10 (located on the outer circumferential side of the center electrode 20) is cooled by not only the fresh air but also the center electrode 20. As a result, the temperature of the front end portion 300 of the insulator 10 becomes decreased due to temperature decreases of the center electrode 20. It is assumed that, when the thermal shock resistance is high, it is possible to suppress breakage of the insulator 10 of the spark plug 100 mounted on the internal combustion engine.

As shown in FIG. 3A, samples No. 1 to No. 7 in which the surface roughness Ra was set to 0.03 μm, 0.04 μm, 0.1 μm, 1 μm, 2 μm, 1 μm and 0.1 μm had a thermal shock resistance score of 10, 10, 10, 8, 1, 1 and 1, respectively.

The thermal shock resistance was particularly low in sample No. 5 in which the surface roughness Ra of the inner circumferential surface Sa, Sb of the front end portion 300 of the insulator 10 was set to 2 μm and in samples No. 6 and 7 in which no step was formed on the inner circumferential surface Sa, Sb of the front end portion 300 of the insulator 10. The reason for this low thermal shock resistance is assumed as follows. When the surface roughness Ra is great as in sample No. 5, the inner circumferential surface Sa, Sb of the front end portion 300 is not smooth and has fine unevenness. It is likely that stress caused by temperature changes will be concentrated on uneven areas. Hence, the front end portion 300 with such an uneven inner circumferential surface Sa, Sb is susceptible to breakage. When the distance Lb is zero (i.e. the step is not formed) as in samples No. 6 and 7, the second (front-side) section 320 of the front end portion 300 is situated adjacent or close to the center electrode 20 so that the temperature of the front end portion 300 of the insulator 100 is acceleratedly decreased due to temperature decreases of the center electrode 20. Further, the second section 320 is large in radial thickness and large in volume when the distance Lb is zero. In such a case, the second section 320 receives a large stress as the amount of volume change of the second section 320 due to temperature changes becomes large. The front end portion 300 with no step is hence susceptible to breakage.

The samples in which the surface roughness Ra was set to 0.03 μm, 0.04 μm, 0.1 μm or 1 μm had a good thermal shock resistance score of 8 or higher. It is feasible to use any arbitrary one of the above surface roughness values as the upper limit of the preferable range of the surface roughness Ra. For example, the surface roughness Ra may be 1 μm or smaller. It is also feasible to use, as the lower limit of the preferable range of the surface roughness Ra, any arbitrary one of the above surface roughness values smaller than the upper limit surface roughness value. For example, the surface roughness Ra may be 0.3 μm or greater. The smaller the value of the surface roughness Ra, the more smooth the inner circumferential surface of the insulator 10 (in particular, the inner circumferential surface Sa, Sb of the front end portion 300), the more suppressed the concentration of stress on a part of the inner circumferential surface. For this reason, the surface roughness Ra may preferably be in the range of 0 to 1 μm from the viewpoint of suppressing breakage of the front end portion. In the present invention, the surface roughness Ra may alternatively be greater than 1 μm.

When the surface roughness Ra of the inner circumferential surface Sa, Sb of the front end portion 300 is in the above preferable range, it is possible to suppress concentration of stress caused by temperature changes regardless of the other configurations (parameter values) of the front end portion 300. The above preferable range of the surface roughness Ra is thus applicable to the insulator 10 whose front end portion 300 is of various shapes and sizes. For example, at least one of the length La, the distance Lb, the angle AG and the distance Lc may be different from that of the above samples.

B2. Second Evaluation Test

The second evaluation test was performed to examine the influence of the angle AG (see FIG. 2) on the thermal shock resistance and fouling resistance of the insulator 10. In the second evaluation test, five types of samples of the spark plug 100 (samples No. 8 to No. 12) with different values of AG were used. The angle AG was adjusted by varying the position of the first point P1 in the direction parallel to the axis CL. The other configurations of the spark plug 100 were common to samples No. 8 to No. 12. For example, the following common parameters were used: Ra=0.1 μm; La=0.9 mm; Lb=30 μm; and Lc=0.3 mm.

The thermal shock resistance was evaluated in the same manner as explained above.

The fouling resistance was evaluated by the following test operation procedure according to JIS D 1606. A test vehicle having a four-cylinder natural-intake MPI (Multipoint Fuel Injection) engine with a displacement of 1.6 L was placed on a chassis dynamometer in a low-temperature test room of −10° C. The spark plug 100 was mounted to each cylinder of the engine of the test vehicle. The test vehicle was then subjected to repeated cycle of first and second operations. Herein, the first operation included "three idling events", "running in the third gear at 35 km/h for 40 seconds", "90-second idling", "running in the third gear at 35 km/h for 40 seconds", "engine stop" and "vehicle cooling until a coolant temperature of −10° C." in this order; and the second operation included "three idling events", "running in the first gear at 15 km/h for 20 seconds three times via 30-second engine stops, "engine stop" and "vehicle cooling until a coolant temperature of −10° C." in this order.

In the above test operation procedure, there occurred carbon fouling on the outer surface (e.g. inner and outer circumferential surfaces) of the insulator 10 of the spark plug 100. As the occurrence of such carbon fouling would cause an unintentional discharge along a path through the outer surface of the insulator 10, it is preferable that the amount of carbon fouling on the outer surface of the insulator 10 is as small as possible. In this evaluation test, the electrical resistance between the metal shell 50 and the terminal electrode 40 of the spark plug 100 was measured after the completion of the test operation procedure. The larger the amount of carbon fouling on the outer surface of the insulator 10, the easier the flow of electrical current between the metal shell 50 and the center electrode 20 through the carbon fouling, the lower the electrical resistance between the metal shell 50 and the terminal electrode 40. The test operation procedure was repeated until the electrical resistance became lower than 10 MΩ.

The fouling resistance score was given as a measure of the number of times of the test operation procedure repeated until the electrical resistance became lower than 10 MΩ. More specifically, the fouling resistance score was set as: "1" when the number of times of the test operation procedure repeated was less than 10; "5" when the number of times of the test operation procedure repeated was 10 or more and less than 13; and "10" when the number of times of the test operation procedure repeated was 13 or more. The higher the fouling resistance score, the higher the fouling resistance of the insulator 10.

As shown in FIG. 3B, samples No. 8 to No. 12 in which the angle AG was set to 35°, 75°, 90°, 105° and 150° respectively had a thermal shock resistance score of 10, 10, 10, 10 and 5 and a fouling resistance score of 5, 10, 10, 10 and 10. In the case where the angle AG is 90°, the connection surface region Sa2 (see FIG. 2) is perpendicular to the axis CL. In the case where the angle AG is greater than 90°, the second point P2 is located rearward of the first point P1; and the connection surface region Sa2 extends radially outwardly and diagonally in the rearward direction Dfr from the first point P1.

The thermal shock resistance was high when the angle AG was small. The reason for this is assumed as follows. In the cross section of FIG. 2, the angle AG1 of the corner C1 between the surface regions Sa1 and Sa2 (with the vertex of the angle AG1 being on the first point P1) becomes greater as the angle AG becomes smaller. The angle AG1 is approximately equal to a value of "180°—angle AG". When the angle AG1 is great, it is possible to prevent stress caused by temperature changes from being concentrated on the corner C1 and thereby possible to achieve high thermal shock resistance.

On the other hand, the fouling resistance was low when the angle AG was small. The reason for this is assumed as follows. During operation of the internal combustion engine, combustion gas flows in the rearward direction Dfr and enters the clearance between the insulator 10 and the center electrode 20 (see FIG. 2). In such a clearance, the combustion gas comes into contact with the connection surface region Sa2 and then flows in the rearward direction Dfr along the connection surface region Sa2. When the angle AG is great, the flow of the combustion gas along the connection surface region Sa2 is not directed to the clearance between the first surface region Sa1 and the center electrode 20 but is directed to the lateral side surface 20*s* of the center electrode 20 or to the second point P2. It is hence possible to suppress the introduction of the combustion gas into the clearance between the first surface region Sa1 and the center electrode 20 when the angle AG is great. When the angle AG is small, however, the flow of the combustion gas along the connection surface region Sa2 is directed to the clearance between the first surface region Sa1 and the center electrode 20 so that the combustion gas would be readily introduced into the clearance between the first surface region Sa1 and the center electrode 20. Hence, the fouling resistance becomes low due to the occurrence of carbon fouling in the clearance between the first surface region Sa1 and the center electrode 20 when the angle AG is small.

The samples in which the angle AG was set to 75°, 90° or 105° had a good thermal shock resistance score of 10 and a good fouling resistance score of 10. It is feasible to use any arbitrary one of the above angle values as the lower limit of the preferable range of the angle AG. For example, the angle AG may preferably be 75° or greater. It is also feasible to use, as the upper limit of the preferable range of the angle AG, any arbitrary one of the above angle values greater than the lower limit angle value. For example, the angle AG may preferably be 105° or smaller. In the present invention, the angle AG may alternatively be smaller than 75° or be greater than 105°.

When the angle AG is in the above preferable range, it is possible to prevent stress caused by temperature changes from being concentrated on the corner C and to suppress the introduction of gas in the clearance between the first surface region Sa1 and the center electrode 20 regardless of the other configurations (parameter values) of the front end portion 300. The above preferable range of the angle AG is thus applicable to the insulator 10 whose front end portion 300 is of various shapes and sizes. For example, at least one of the surface roughness Ra, the length La, the distance Lb and the distance Lc may be different from that of the above samples.

B3. Third Evaluation Test

The third evaluation test was performed to examine the influence of the distance Lb (see FIG. 2) on the thermal shock resistance and withstand voltage of the insulator 10. In the third evaluation test, nine types of samples of the spark plug 100 (samples No. 13 to No. 21) with different values of Lb were used. The distance Lb was adjusted by varying the position of the P2 in the direction perpendicular to the axis CL without varying the position of the third point P3 (see FIG. 2). The other configurations of the spark plug 100 were common to samples No. 13 to No. 21. For example, the following common parameters were used: Ra=0.1 μm; La=0.9 mm; AG=90°; and Lc=0.3 mm.

The thermal shock resistance was evaluated in the same manner as explained above.

The withstand voltage, which indicates the unlikelihood of occurrence of a discharge through the front end portion 300 of the insulator 10, was evaluated as follows. Each sample of the insulator 10 was fitted around the center electrode 20 by inserting the center electrode 20 in the front end side of the axial hole 12 of the insulator 10. At this time, the position of the center electrode 20 was the same as that in the spark plug 100 of FIG. 1. The insulator 10 with the center electrode 20 was immersed in an insulating oil. A ring-shaped electrode (hereinafter simply referred to as "ring electrode") having a through hole in which the front end portion 300 of the insulator 10 was insertable was provided. In the insulating oil, the front end portion 300 of the insulator 10 was inserted in the through hole of the ring electrode. The ring electrode was positioned 5 mm apart from the front end surface Sf of the insulator 10 in the rearward direction Dfr, that is, located rearward of the front end portion 300 of the insulator 10. In this state, a voltage was applied between the ring electrode and the center electrode 20 in the insulating oil. It was confirmed by monitoring the electrical current whether there occurred a discharge between the ring electrode and the center electrode 20 through the insulator 10. Such a penetration discharge could occur in various parts of the insulator 10 (such as the first section 310, the second section 320 and any part of the insulator 10 other than the front end portion 300). The voltage applied was increased until the occurrence of the penetration discharge. The voltage at which the penetration discharge occurred was determined. The determined voltage was a maximum voltage (called "withstand voltage") at which the penetration discharge could be suppressed. Ten samples for each type were used in the third evaluation test. An average value of the withstand voltage determination results of the ten samples were calculated as an average withstand voltage.

The withstand voltage score was given as a measure of the average withstand voltage. In this evaluation test, the average withstand voltage of sample No. 3 (see FIG. 3A) was determined as a "reference withstand voltage"; and the withstand voltage score was set as "10" for the reference withstand voltage and was deducted by 1 for every 0.5-kV decrease in average withstand voltage. For example, the withstand voltage score was 9 when the average withstand voltage was higher than a value of "reference withstand voltage −0.5 kV" and lower than or equal to a value of "reference withstand voltage −0.5 kV". The higher the withstand voltage score, the higher the withstand voltage (average withstand voltage).

As shown in FIG. 3C, samples No. 13 to No. 21 in which the distance Lb was set to 1 μm, 5 μm, 15 μm, 30 μm, 80 μm, 100 μm, 200 μm, 500 μm and 1000 μm respectively had a thermal shock resistance score of 5, 8, 10, 10, 10, 10, 10, 10 and 10 and a withstand voltage score of 10, 10, 10, 10, 10, 10, 8, 7 and 5.

The thermal shock resistance was high when the distance Lb was great. The reason for this is assumed as follows. When the distance Lb is great, the second (front-side) section 320 of the front end portion 300 of the insulator 10 is situated apart from the center electrode 20. It is thus possible to suppress temperature decreases of the front end portion 300 (in particular, the second section 320) of the insulator 10 due to temperature decreases of the center electrode 20. In addition, the second section 320 is small in radial thickness and small in volume when the distance Lb is great. It is thus possible to reduce stress caused to the second section 320 as the amount of volume change of the second section 320 due to temperature changes is decreased. Hence, the front end portion 300 (the second section 320) is less susceptible to breakage.

Further, the withstand voltage was high when the distance Lb was small. The reason for this is assumed as follows. When the distance Lb is small, the second (front-side) section 320 of the front end portion 300 of the insulator 10 is large in radial thickness. It is thus possible to suppress a discharge penetrating through the second section 320.

The samples in which the distance Lb was set to 5 μm, 15 μm, 30 μm, 80 μm, 100 μm, 200 μm or 500 μm had a good thermal shock resistance score of 8 or higher and a good withstand voltage score of 7 or higher. It is feasible to use any arbitrary one of the above distance values as the lower limit of the preferable range of the distance Lb. For example, the distance Lb may be 5 μm or greater or may be 15 μm or greater. It is also feasible to use, as the upper limit of the preferable range of the distance Lb, any arbitrary one of the above distance values greater than the lower limit distance value. For example, the distance Lb may be 500 μm or smaller or may be 100 μm or smaller. The distance Lb may preferably be in the range of 55 μm to 500 μm, more preferably 15 μm to 100 μm. In the present invention, the distance Lb may alternatively be smaller than 5 μm or be greater than 500 μm.

When the distance Lb is in the above preferable range, it is possible to suppress temperature decreases of the front end portion 300 of the insulator 10 caused by temperature decreases of the center electrode 200 and to prevent the occurrence of a discharge through second section 320 of the front end portion 300 regardless of the other configurations (parameter values) of the front end portion 300. The above preferable range of the distance Lb is thus applicable to the insulator 10 whose front end portion 300 is of various shapes and sizes. For example, at least one of the surface roughness Ra, the length La, the angle AG and the distance Lc may be different from that of the above samples.

B4. Fourth Evaluation Test

The fourth evaluation test was performed to examine the influence of the distance Lc (see FIG. 2) on the thermal shock resistance and withstand voltage of the insulator 10. In the fourth evaluation test, five types of samples of the spark plug 100 (samples No. 22 to No. 26) with different values of Lc were used. The other configurations of the spark plug 100 were common to samples No. 22 to No. 26. For example, the following common parameters were used: Ra=0.1 μm; La=0.9 mm; Lb=30 μm; and AG=90°.

The thermal shock resistance and withstand voltage were evaluated in the same manner as explained above.

As shown in FIG. 3D, samples No. 22 to 26 in which the distance Lc was set to 0.05 mm, 0.1 mm, 0.2 mm, 3 mm and 5 mm respectively had a thermal shock resistance score was 9, 10, 10, 10 and 10 and a withstand voltage score of 10, 10, 10, 10 and 8.

The thermal shock resistance was low when the distance Lc was small (0.05 mm) as in sample No. 22. The reason for this is assumed as follows. When the distance Lc is small, the chamfered area 321 is decreased in size so that the connection angle between the front end surface Sf and the inner circumferential surface Sb, which defines the connection point P3, becomes acute. As it is likely that stress caused by temperature changes will be concentrated on the acute connection point P3, the front end portion 300 is susceptible to breakage.

Further, the withstand voltage was low when the distance Lc was great (5 mm) as in sample No. 26. The reason for this is assumed as follows. When the distance Lc is great, the second section 320 small in radial thickness becomes increased. It is thus likely that there will occur a discharge penetrating through the second section 320.

The samples in which the distance Lc was set to 0.1 mm, 0.2 mm or 3 mm had a good thermal shock resistance score of 10 and a good withstand voltage score of 10. It is feasible to use any arbitrary one of the above distance values as the lower limit of the preferable range of the distance Lc. For example, the distance Lc may be 0.1 mm or greater It is also feasible to use, as the upper limit of the preferable range of the distance Lc, any arbitrary one of the above distance values greater than the lower limit distance value. In the present invention, the distance Lc may alternatively be smaller than 0.1 mm or be greater than 3 mm. Even in this case, it is preferable to set the distance Lc smaller than the distance Ld from the front end (front end surface 55) of the metal shell 50 to the front end (front end surface Sf) of the insulator 10 in the direction parallel to the axis CL (see FIG. 2).

When the distance Lc is in the above preferable range, it is possible to prevent stress caused by temperature changes from being concentrated on the connection point P3 and to prevent the occurrence of a discharge through second section 320 of the front end portion 300 regardless of the other configurations (parameter values) of the front end portion 300. The above preferable range of the distance Lc is thus applicable to the insulator 10 whose front end portion 300 is of various shapes and sizes. For example, at least one of the surface roughness Ra, the length La, the angle AG and the distance Lb may be different from that of the above samples.

C. Second Embodiment

Figure 4:
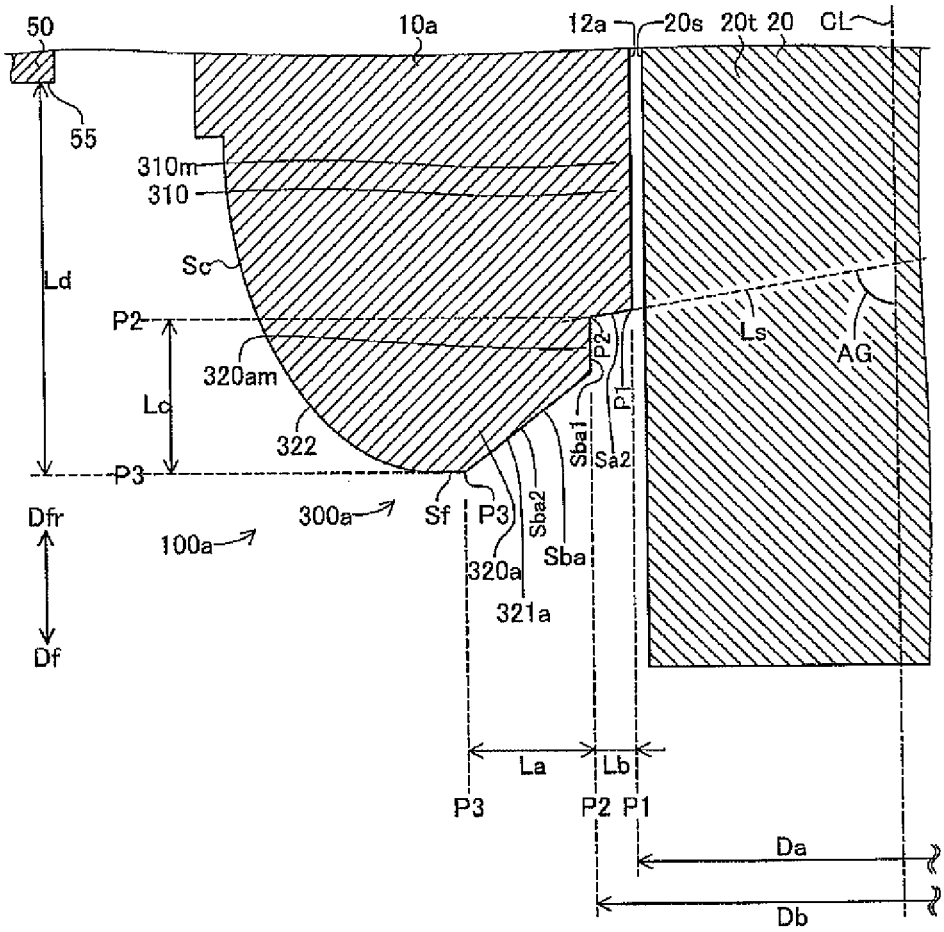
FIG. 4 shows a schematic view of a spark plug according to a second embodiment of the present invention.

FIG. 4 shows a schematic view of a spark plug 100*a* according to a second embodiment of the present invention. In FIG. 4, a part of a cross section of the spark plug 100*a* corresponding to FIG. 2 is shown.

The spark plug 100*a* according to the second embodiment is similar to the spark plug 100 according to the first embodiment, except for the configuration of a chamfered area 321*a* on an insulator 10*a*. The same parts and portions of the spark plug 100*a* as those of the spark plug 100 are designated by the same or like reference numerals, and their detailed explanations will be omitted to avoid redundancy.

In the second embodiment, the spark plug 100*a* has an insulator 10*a* formed with an axial hole 12*a*. A front end portion 300*a* of the insulator 10*a* consists of a first (rear-side) section 310 and a second (front-side) section 320*a* located adjacent to and frontward of the first section 310. An inner circumferential surface Sba of the second section 320*a* includes a first (rear-side) surface region Sba1 connected to a connection surface region Sa2 of the first section 310 and a second (front-side) surface region Sba2 connected to a front side of the first surface region Sba1. Herein, the connection point of the first surface region Sba1 to the connection surface region Sa2 of the first section 310 is referred to as a second point P2; and the connection point of the second surface region Sba2 to the front end surface Sf is referred to as a third point P3. The first surface region Sba1 has a constant inner diameter Db throughout its length regardless of the position in the direction of the axis CL. A part of the second section 320 defining the first surface region Sba1 serves as a minimum inner diameter part 320*am*. The second surface region Sba2 has an inner diameter gradually increasing in the frontward direction Df. In the cross section of FIG. 4, the second surface region Sba2 is represented by a straight line extending diagonally with respect to the axis CL. In the second embodiment, this second surface region Sba2 is formed as a chamfered area 321*a*. Namely, the chamfered area 321*a* is in the form of a so-called C-chamfered area in the second embodiment. The term "C-chamfered" means that the chamfered area has a shape defined by at least one straight line segment when viewed in cross section.

In the spark plug 100*a*, at least one arbitrary parameter selected from the surface roughness Sa, the angle AG, the distance Lb and the distance Lb may preferably be set within the above-mentioned preferable range. In this case, the spark plug 100*a* attains various advantages as in the case of the spark plug 100.

D. Modification Examples

The present invention is applicable to various forms of spark plugs. For example, the following modifications can be made to the above first and second embodiments.

In the first embodiment (FIG. 2), the insulator 10 may have a cylindrical part of constant inner diameter between the chamfered area 321 and the connection surface region Sa2. In other words, the inner circumferential surface Sb of the second section 320 may include a first (rear-side) surface region constant in inner diameter and connected to the connection surface region Sa2 and a second (front-side) surface region connected to a front side of the first surface region and formed with the chamfered area 321. When viewed in cross section along the axis CL, the R-chamfered area 321 may have a shape defined by a circular arc or defined by a curve other than an arc (e.g. an oval curve). In either case, it is preferable that the R-chamfered area 321 has a curved cross-sectional shape convex toward the outside of the insulator 10.

In the second embodiment (FIG. 4), the second surface region Sba1 of constant inner diameter may not be provided on the inner circumferential surface Sba of the second section 320*a*; and the chamfered area 321*a* may be formed on the entire circumferential surface Sba of the second section 320*a*. The C-chamfered area 321*a* may have a shape defined by a polygonal line with a plurality of starlight line segments, rather than by defined by one straight line segment, when viewed in cross section along the axis CL. In general, it suffices that the C-chamfered area 321 has a shape defined by N pieces of straight line segments (where N is an integer of 1 or greater) when viewed in cross section along the axis CL. It is also preferable that the C-chamfered area 321*a* has a curved cross-sectional shape convex toward the outside of the insulator 10.

The configurations of the spark plug 100, 100*a* are not limited to those of the above embodiments.

For example, the front-side packing 8 may not be provided as mentioned above. In this case, the insulator 10, 10*a* is supported directly on the inwardly protruding portion 56 of the metal shell 50 by direct contact of the rear surface 56*r* of the inwardly protruding portion 56 with the outer diameter decreasing portion 16 of the insulator 10, 10*a*.

The discharge gap g may be defined between the lateral side surface of the center electrode 20 (parallel to the axis CL) and the ground electrode 30, rather than defined between the front end surface of the center electrode 20 and the ground electrode 30. It is alternatively feasible to define two or more discharge gaps g between the center electrode 20 and the ground electrode 30.

The resistor 73 may not be provided. A magnetic member may be arranged between the center electrode 20 and the terminal electrode 40 within the through hole 12, 12*a* of the insulator 10, 10*a*.

The ground electrode 30 may not be provided. In this case, the spark plug 100, 100*a* is configured to generate a discharge between the center electrode 20 and any other structural member exposed inside the combustion chamber.

In each of the first and second embodiments, at least any one of the parameters Ra, AG, Lb and Lc of the inner circumferential surface Sa, Sb of the front end portion 300, 300*a* of the insulator 10, 10*a* can be set within the above-mentioned preferable range as mentioned above. Nevertheless, the present invention does not exclude the case where all of these parameters are out of the preferable ranges.

The entire contents of Japanese Patent Application No. 2017-137682 (filed on Jul. 14, 2017) are herein incorporated by reference.

Although the present invention has been described with reference to the above specific embodiments and modifications, the above embodiments and modifications are intended to facilitate understanding of the present invention and are not intended to limit the present invention thereto. Various changes and modifications can be made without departing from the scope of the present invention; and the present invention includes equivalents thereof. The scope of the invention is defined with reference to the following claims.

Having described the invention, the following is claimed:

1. A spark plug, comprising:

an insulator having an axial hole formed in a direction of an axis of the spark plug;

a center electrode disposed in the axial hole and having a part thereof corresponding in position to at least a front end of the insulator; and a metal shell fixed around an outer circumference of the insulator, with a front end portion of the insulator protruding frontward from a front end of the metal shell, wherein the front end portion of the insulator consists only of a first section located on a rear side thereof and a second section located adjacent to and frontward of the first section and having an inner diameter larger than that of the first section, and wherein the second section has, formed on an inner circumferential surface thereof; a chamfered area continuing to the front end of the insulator.

2. The spark plug according to claim 1, wherein an inner circumferential surface of the first section includes a connection surface region facing frontward and connected to the second section, and wherein, assuming that, in a cross section of the spark plug taken including the axis, a straight line passes through both ends of a line segment corresponding to the connection surface region, an angle formed between the axis and the straight line on a side frontward of the connection surface region is 75 degrees or greater.

3. The spark plug according to claim 1, wherein a distance between inner circumferential surfaces of minimum inner diameter parts of the first and second sections in a direction perpendicular to the axis is greater than or equal to 5 μm and smaller than or equal to 500 μm.

4. The spark plug according to claim 3, wherein the distance between the inner circumferential surfaces of the minimum inner diameter parts of the first and second sections in the direction perpendicular to the axis is greater than or equal to 15 μm and smaller than or equal to 100 μm.

5. The spark plug according to claim 1, wherein a distance from the front end of the insulator to a rear end of the second section in the direction of the axis is 0.1 mm or greater.

6. The spark plug according to claim 1, wherein an inner circumferential surface of the front end portion of the insulator has a surface roughness of 1 μm or smaller.

7. The spark plug according to claim 1, wherein the chamfered area is a C-chamfered area or a R-chamfered area.

* * * * *